US011697562B2

(12) United States Patent
Fukada

(10) Patent No.: US 11,697,562 B2
(45) Date of Patent: Jul. 11, 2023

(54) SHEET FEEDING DEVICE AND IMAGE FORMING APPARATUS

(71) Applicant: CANON KABUSHIKI KAISHA, Tokyo (JP)

(72) Inventor: Ichiro Fukada, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 84 days.

(21) Appl. No.: 17/218,890

(22) Filed: Mar. 31, 2021

(65) Prior Publication Data

US 2021/0309468 A1 Oct. 7, 2021

(30) Foreign Application Priority Data

Apr. 6, 2020 (JP) ..... 2020-068156

(51) Int. Cl.

| | |
|---|---|
| ***B65H 1/14*** | (2006.01) |
| ***B65H 7/20*** | (2006.01) |
| ***B65H 1/08*** | (2006.01) |
| ***B65H 3/06*** | (2006.01) |
| ***B65H 7/02*** | (2006.01) |
| ***B65H 7/18*** | (2006.01) |
| *B65H 1/02* | (2006.01) |

(52) U.S. Cl.

CPC ..... *B65H 1/14* (2013.01); *B65H 1/08* (2013.01); *B65H 3/06* (2013.01); *B65H 3/0607* (2013.01); *B65H 3/0669* (2013.01); *B65H 3/0684* (2013.01); *B65H 7/02* (2013.01); *B65H 7/18* (2013.01); *B65H 7/20* (2013.01); *B65H 1/025* (2013.01)

(58) Field of Classification Search

CPC ..... B65H 1/14; B65H 3/0607; B65H 3/0669; B65H 3/0684; B65H 7/02; B65H 7/18; B65H 2403/51; B65H 2403/512

See application file for complete search history.

(56) References Cited

U.S. PATENT DOCUMENTS

| | | | | |
|---|---|---|---|---|
| 8,152,159 | B2 | 4/2012 | Okumura | |
| 8,430,393 | B2 | 4/2013 | Matsushima et al. | |
| 8,585,040 | B2 * | 11/2013 | Ikeda | B65H 3/042 271/18.1 |
| 2021/0061597 | A1 * | 3/2021 | Matsumoto | B65H 3/0607 |

FOREIGN PATENT DOCUMENTS

| | | | |
|---|---|---|---|
| JP | 05-208734 | A | 8/1993 |
| JP | 06-199428 | A | 7/1994 |
| JP | 11-322094 | A | 11/1999 |
| JP | 2010-064805 | A | 3/2010 |
| WO | 2011/007406 | A1 | 1/2011 |

* cited by examiner

*Primary Examiner* — Prasad V Gokhale
(74) *Attorney, Agent, or Firm* — Venable LLP

(57) ABSTRACT

A sheet feeding device includes a sheet loading portion which is capable of elevating operation and on which a sheet is loaded, a feeding member for feeding the sheet loaded on the sheet loading portion, the feeding member being capable of elevating movement between a contacting position in contact with the sheet and a distanced position distanced upward from the sheet, and a control portion that controls the elevating operation of the sheet loading portion and the elevating movement of the feeding member. When the feeding member at the contacting position moves to the distanced position, the feeding member is distanced upward from the sheet loaded on the sheet loading portion after the sheet loading portion starts a descending operation.

9 Claims, 21 Drawing Sheets

FIG.11

| TRANSITION OF CONTACTING/DISTANCING OPERATIONS | DETECTING STATE OF SENSOR 215 | MEMBER(S) SUPPORTING FEED ROLLER UNIT 21 AND CONTACTING/DISTANCING LEVER 25 |
|---|---|---|
| IN CONTACT (FIGS. 7A AND 7B) | LIGHT-SHIELDING(ON) | LIFT-UP PLATE 31<br>SHEETS S |
| DURING DISTANCING OPERATIONS (FIGS. 8A AND 8B) | TRANSMITTING(OFF) | LIFT-UP PLATE 31<br>SHEETS S |
| DURING DISTANCING OPERATIONS (FIGS. 9A AND 9B) | TRANSMITTING(OFF) | CONTACTING/DISTANCING LINK 37 |
| DISTANCING COMPLETED (FIGS. 10A AND 10B) | LIGHT-SHIELDING(ON) | CONTACTING/DISTANCING LINK 37 |

FIG.20

| TRANSITION OF CONTACTING/DISTANCING OPERATIONS | DETECTING STATE OF SENSOR 215 | MEMBER(S) SUPPORTING FEED ROLLER UNIT 21 AND CONTACTING/DISTANCING LEVER 25 |
|---|---|---|
| IN CONTACT (FIGS. 16A AND 16B) | LIGHT-SHIELDING(ON) | LIFT-UP PLATE 31<br>SHEETS S |
| DURING DISTANCING OPERATIONS (FIGS. 17A AND 17B) | TRANSMITTING(OFF) | LIFT-UP PLATE 31<br>SHEETS S |
| DURING DISTANCING OPERATIONS (FIGS. 18A AND 18B) | TRANSMITTING(OFF) | CONTACTING/DISTANCING SLIDER 40 |
| DISTANCING COMPLETED (FIGS. 19A AND 19B) | LIGHT-SHIELDING(ON) | CONTACTING/DISTANCING SLIDER 40 |

SHEET FEEDING DEVICE AND IMAGE FORMING APPARATUS

BACKGROUND OF THE INVENTION

Field of the Invention

The present invention relates to an image forming apparatus such as a photocopier, a printer, or the like, and to a sheet feeding device provided thereto.

Description of the Related Art

In general, conventional image forming apparatuses such as printers, photocopiers, and so forth, have a configuration provided with a sheet feeding unit for automatically feeding sheets toward an image forming portion that forms images on sheets, and a sheet loading tray that accommodates sheets and that is provided so as to be capable of elevating. Sheet feed units used in such image forming apparatuses are each provided with a pickup roller for feeding a topmost sheet, loaded on the sheet loading tray, to the image forming portion, and a separating portion for separating sheets, fed out from the pickup roller, into individual sheets. The sheet loading tray is provided with a sheet storage portion for storing sheets, and can store up to a certain number of sheets of a plurality of standard sizes. When sheets are stored in an apparatus main unit along with the tray, the sheets are lifted up by a tray elevating portion that elevates the sheets at the time of a feeding operation, and the pickup roller comes into contact with the topmost sheet. The elevating operation is further continued thereafter, then the sheets are raised to a position from which feeding can be performed, while in contact with the pickup roller. Using switch over of a signal of a sensor that detects the position of the pickup roller enables the position of the topmost sheet at the time of starting the feeding operation to be made constant, regardless of the number of sheets stored or the size thereof, thereby implementing stable feeding operations.

In a sheet feeding unit and a sheet loading tray having a configuration such as described above, the contact state between the pickup roller and the topmost sheet is maintained even after the feeding operation ends. If a long period of time passes with the roller and the sheet remaining in contact, there is a possibility that oil component of the roller rubber seeps into the sheet, a press mark of the roller remains on a sheet, or the like. Using such a sheet for printing may result in an image defect due to change in the surface properties thereof. Accordingly, the contact state between the pickup roller and the sheet is preferably disengaged after the feeding operation, and the two are distanced from each other. In order to prevent the image defect due to this contact state being continued for a long period of time, approaches, such as lowering the sheet loading tray from the contact state (Japanese Patent Application Publication No. 2010-064805), or raising the pickup roller (WO 2011/007406), are commonly used.

SUMMARY OF THE INVENTION

However, the above-described conventional examples have a problem in that variance in distancing positions between a sheet conveying tray and a pickup roller increases.

It is an object of the present invention to provide technology enabling detection of a distanced state in control of distancing a feeding member, such as a feed roller, from a sheet loaded on a sheet loading portion such as a sheet conveying tray or the like, with little variance, and by a simple configuration.

In order to achieve the above object, a sheet feeding device according to the present invention includes:

a sheet loading portion which is capable of an elevating operation, and on which a sheet is loaded;

a feeding member for feeding the sheet loaded on the sheet loading portion, the feeding member being capable of elevating movement between a contacting position in contact with the sheet, and a distanced position distanced upward from the sheet; and a control portion that controls the elevating operation of the sheet loading portion and the elevating movement of the feeding member, wherein, when the feeding member at the contacting position moves to the distanced position, the feeding member is distanced upward from the sheet loaded on the sheet loading portion after the sheet loading portion starts a descending operation.

As described above, according to the present invention, variance in distancing positions can be reduced, without necessitating addition of new position detecting means for control of distancing of the feeding member from the sheet.

Further features of the present invention will become apparent from the following description of exemplary embodiments with reference to the attached drawings.

BRIEF DESCRIPTION OF THE DRAWINGS

FIG. 11 is a table showing relations among distancing operations of the feed roller and the lift-up plate according to the first embodiment, detection states of a sensor that detects positions of the feed roller, and a feed roller unit and a member supporting a contact/distancing lever;

FIG. 20 is a table showing relations among distancing operations of the feed roller and the lift-up plate according to the second embodiment, detection states of a sensor that detects positions of the feed roller, and a feed roller unit and a member supporting a contact/distancing lever.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments are not intended to limit the scope of the invention to the following embodiments.

First Embodiment

Overall Configuration

Figure 1:
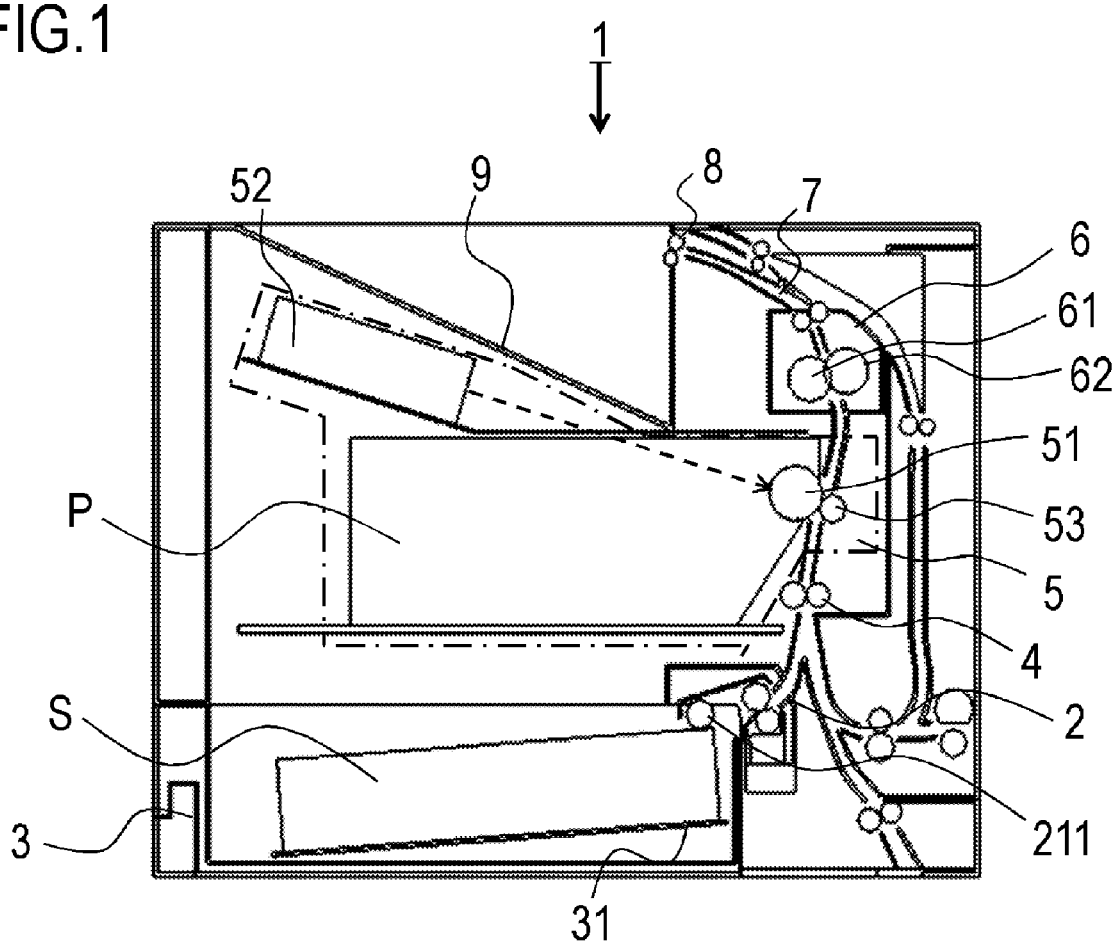
FIG. 1 is a cross-sectional view illustrating an overall configuration of an image forming apparatus main unit.

FIG. 1 is a schematic cross-sectional view illustrating an overall configuration of an image forming apparatus and a sheet feed device. The image forming apparatus 1 forms images by an electrophotographic recording process, in which sheets (recording material) S are conveyed to an image forming portion, toner images are transferred thereupon, the sheets S are conveyed to a fixing portion where the toner images are fixed, and thereafter discharged to a discharge portion.

The sheets S are stored loaded in a cassette unit 3 serving as a sheet loading portion, which is loaded at a lower portion of the apparatus. The sheets S are fed out in order from the topmost sheet, by a feed roller 211 that rotates in a counterclockwise direction and that is provided in a feed unit 2 for feeding sheets S onto a sheet conveyance path of the apparatus main unit of the image forming apparatus 1, toward an image forming portion 5. The sheets S are sent to the image forming portion 5 by a conveying roller pair 4. The image forming portion 5 uses a cartridge method in which a photosensitive drum 51 and process unit that act upon the photosensitive drum 51 are integrally formed into a cartridge, and this cartridge P is detachably mountable to the apparatus main unit.

At the image forming portion 5, an electrostatic latent image is formed on the photosensitive drum 51 by the photosensitive drum 51 being irradiated by laser light by a laser scanner 52 in accordance with image information. Thereafter, toner development is performed at a developing portion (omitted from illustration) within the process cartridge P. This toner image is then transferred to the sheet S sent to the image forming portion 5 as an unfixed image by application of bias to a transfer roller 53, and thereafter is sent to a fixing portion 6. The fixing portion 6 forms a fixing nip by a heating unit 61 configured of a fixing film, a ceramic heater or the like serving as heating member, disposed on inner face side of the fixing film, and a pressurizing roller 62 that performs pressuring thereof. The unfixed image becomes permanently fixed by the sheet S passing through this fixing nip. The sheet S then passes over a sheet discharge path 7, is discharged to the outside of the apparatus by a discharge roller pair 8, and is loaded on a discharge tray 9.

Although an electrophotographic image forming process using a transfer portion and a fixing portion is employed in the image forming portion that forms images on sheets S in the present embodiment, the present invention is not limited thereto. For example, an ink-jet image forming process in which images are formed on sheets by discharging ink liquid from nozzles may be used in the image forming portion that forms images on the sheets S in the present invention.

Feed Unit 2

Figure 2:
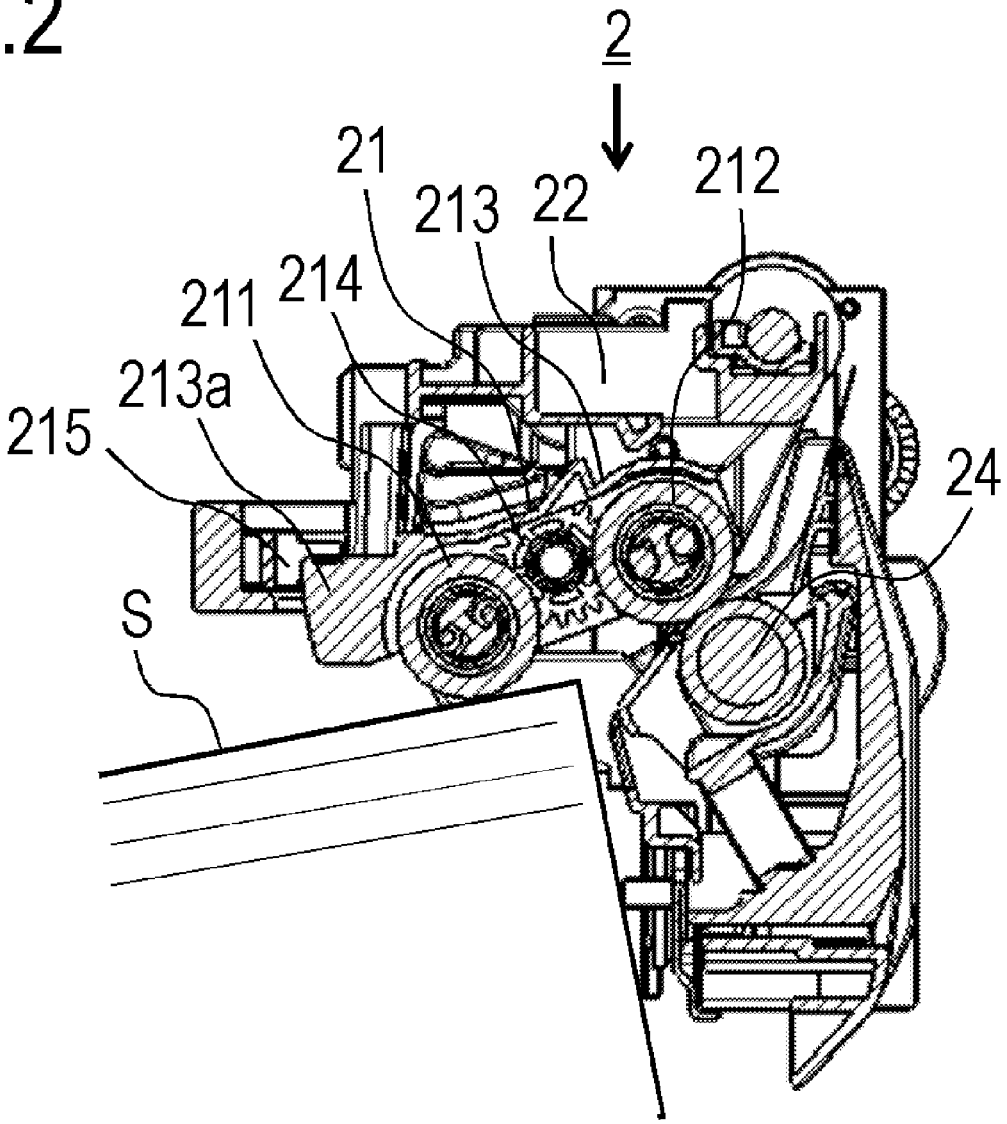
FIG. 2 is a cross-sectional view illustrating a schematic configuration of a feed unit provided to the image forming apparatus.

A detailed configuration of the feed unit 2 installed in the image forming apparatus 1 will be described next with reference to FIG. 2. FIG. 2 illustrates a cross-section of the feed unit 2. In the image forming apparatus 1, the feed unit 2 and the cassette unit 3, and various types of configurations related to operation control thereof, correspond to a sheet feeding device and a sheet feeding portion according to the present invention. Also, out of the various types of configurations of the image forming apparatus 1, a configuration relating to elevating operations of a lift-up plate 31 serving as a later-described sheet loading portion corresponds to a first drive unit according to the present invention. Also, a configuration relating to elevating movement of the feed roller 211 serving as a later-described feeding member corresponds to a second drive unit according to the present invention. Further, a configuration relating to control of each of these units corresponds to a control portion according to the present invention.

The feed unit 2 illustrated in FIG. 2 is able to convey sheets S loaded on the lift-up plate 31 within the cassette unit 3 serving as a sheet loading portion, to the downstream side of a conveying roller 212. The lift-up plate 31 is pivotably supported by a shaft (omitted from illustration) disposed within the cassette unit 3, and is lifted up until the topmost face of the sheets comes into contact with the feed roller 211 provided to the feed unit 2. The feed roller 211 and the conveying roller 212 are supported by a roller holder (holding member) 213. The roller holder 213 is configured to be capable of rocking, centered on the conveying roller 212 (with the conveying roller 212 as a fulcrum). The roller holder 213 applies a certain feed roller pressure to sheets S loaded on the lift-up plate 31 within the cassette unit 3 under pressure from a feed roller pressuring mechanism (omitted from illustration).

Feed Roller Unit 21

Next, a configuration of a feed roller unit 21 will be described with reference to FIG. 2. In the present embodiment, a unit that includes the feed roller 211, the conveying roller 212, the roller holder 213, and an idler gear 214 is referred to as the feed roller unit 21.

The feed unit 2 and the feed roller unit 21 have sheet detecting unit that detects sheets S loaded on the lift-up plate 31. The sheet detecting unit is configured of a sensor 215 provided to a feeding frame 22 and a detection portion (detected portion) 213*a* provided to the roller holder 213. The sensor 215 is, for example, an optical sensor. A sensor can be used that turns on when a light receiving portion is obstructed from receiving detection light from a photoemitter by the detection portion 213*a* (shielded state), and turns off when the light receiving portion receives the detection light (transmitting state). The feed roller unit 21 is provided to be capable of rocking, as described above. When the sheets S loaded on the lift-up plate 31 and the feed roller 211 come into contact, the feed roller unit 21 moves upwards, and the sensor 215 detects the detection portion 213*a*, thereby detecting the position of the topmost sheet S loaded on the lift-up plate 31 and the position of the feed roller 211.

The sheets S loaded on the lift-up plate 31 come into contact with the feed roller 211, as illustrated in FIG. 2. When the lift-up plate 31 rises under driving force of a lift-up motor 35 serving as a singular drive source, the feed roller 211 comes into contact with the topmost face of the sheets S loaded on the lift-up plate 31, and the feed roller unit 21 is lifted and pivots upward. As described above, in this configuration, the sensor 215 detects the pivoting of the detection portion 213*a* of the roller holder 213, the driving of the lift-up motor 35 is stopped and rocking of the lift-up plate 31 stops, and the position of the sheets S is decided. In a state where no sheets S are loaded, the lift-up plate 31 comes into contact with the feed roller 211, and the position of the lift-up plate 31 is decided. Accordingly, the position of the sheets S loaded on the lift-up plate 31 is constantly a position from which sheets S can be fed by the feed roller 211.

Next, operations of feeding sheets S will be described. A sheet conveying motor (omitted from illustration) attached to the apparatus main unit is driven to rotate the feed roller 211 and the conveying roller 212. Sheets S fed by the feed roller 211 are separated into individual sheets by the conveying roller 212 and a separating roller 24, and are fed to the conveying roller pair 4. As sheets S are fed to the image forming portion and there are fewer sheets S loaded on the lift-up plate 31, the feed roller 211 gradually moves downward.

When a certain number of sheets S are fed and the detection portion 213*a* of the roller holder 213 moves to a position at which it is no longer detected by the sensor 215, the lift-up motor 35 raises the lift-up plate 31 again. The lift-up plate 31 is lifted to a position at which the detection portion 213*a* of the roller holder 213 is detected by the sensor 215. Accordingly, the height of the sheets S loaded on the lift-up plate 31 is controlled to constantly be within a certain range.

Lift-Up Configuration of Cassette Unit 3

Figure 3A:
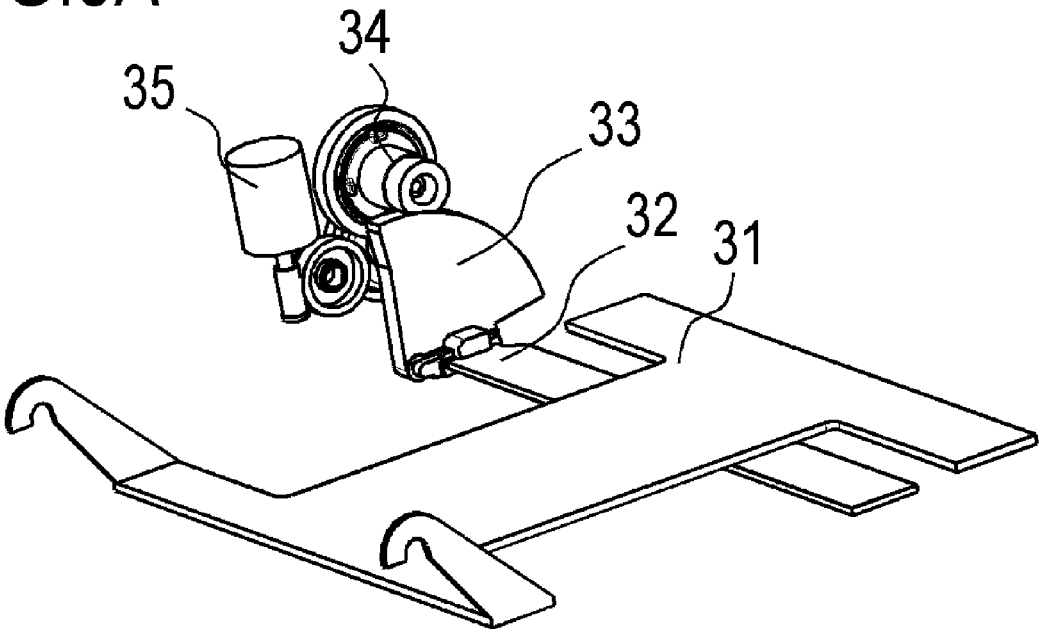
FIGS. 3A and 3B are perspective views illustrating a schematic configuration of a lift-up configuration according to an embodiment of the present invention, within a cassette provided in the image forming apparatus.
Figure 3B:
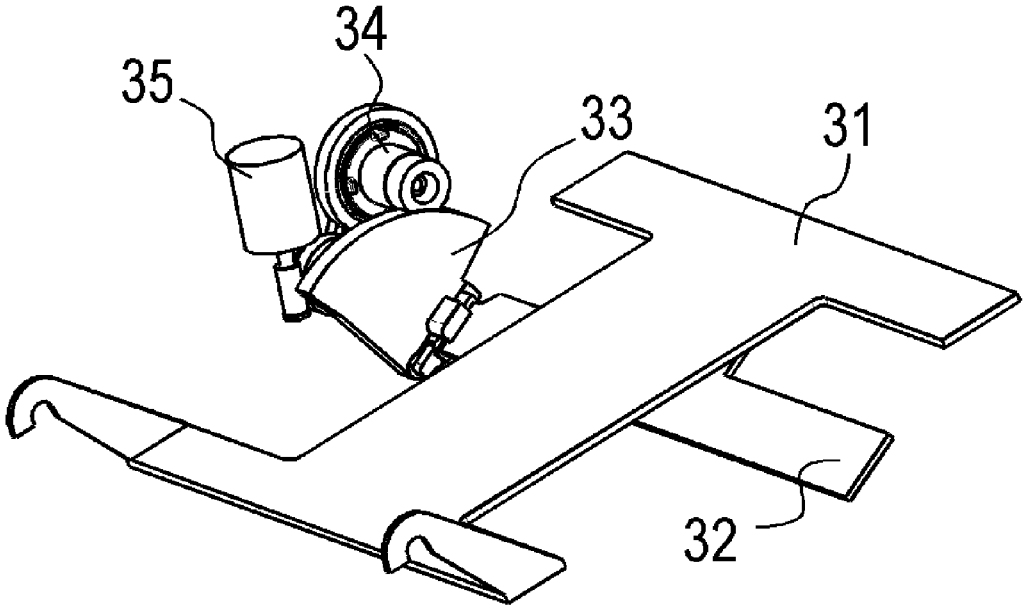

Next, a lift-up configuration within the cassette unit 3 installed in the image forming apparatus 1 will be described with reference to FIGS. 3A and 3B. FIGS. 3A and 3B are perspective views illustrating a schematic configuration of the lift-up configuration within the cassette unit 3. FIG. 3A illustrates an initial state, and FIG. 3B illustrates a lift-up state.

The lift-up configuration illustrated in FIGS. 3A and 3B is configured of the lift-up plate 31, a lift-up member 32 that lifts the lift-up plate 31, a lift-up input gear 34 that transmits drive force from the lift-up motor 35 to the lift-up member 32, and a lift-up output gear 33. Driving the lift-up motor 35 transmits driving force to the lift-up input gear 34 and the lift-up output gear 33. The lift-up output gear 33 is connected to the lift-up member 32, and the lift-up member 32 is made to pivot at the same time as driving of the lift-up output gear 33. The lift-up plate 31 pivots centered on a shaft (omitted from illustration) provided within the cassette main unit in which various sizes of sheets S are loaded and stored, and lifted by the lift-up member 32 such that the sheets S loaded thereupon are pressed toward the feed roller 211, as illustrated in FIG. 3B.

A first embodiment of the present invention will be described with reference to FIG. 4 through FIGS. 12A and 12B.

Figure 4:
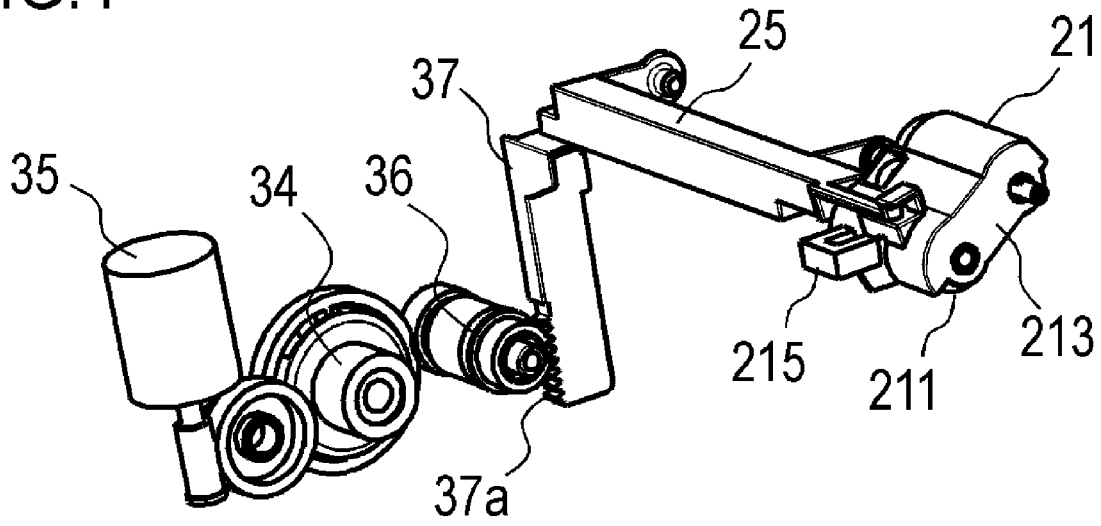
FIG. 4 is a perspective view illustrating a schematic configuration of a linking configuration that links between a lift-up drive provided to the image forming apparatus and a feed roller contacting/distancing configuration, which is a first embodiment of the present invention.

First, the overall configuration will be described with reference to FIG. 4. FIG. 4 represents a linking configuration that links between a lift-up drive and a feed roller contacting/distancing portion, which is the first embodiment of the present invention. The linking configuration, up to the lift-up plate 31, is as described above. The feed roller contacting/distancing portion is configured including a contacting/distancing gear 36 that transmits driving of the lift-up motor 35, a contacting/distancing link 37 that is connected to the contacting/distancing gear 36, and a contacting/distancing lever 25 that is connected to the contacting/distancing link 37 and to the feed roller unit 21, and that is capable of pivoting up and down. The contacting/distancing link 37 serving as a transmitting portion or a link member is provided to a lift-up drive unit, and the contacting/distancing lever 25 serving as a force-transmitted portion or a lever member is provided to the feeding frame 22. The contacting/distancing link 37 is configured so as to be capable of advancing and retracting with regard to the contacting/distancing lever 25.

Also, the feed roller unit 21 pivots in conjunction with pivoting of the contacting/distancing lever 25. A rack 37*a* is provided to the contacting/distancing link 37, thereby converting rotational movement of the contacting/distancing gear 36 that rotates being driven by the lift-up motor 35 into movement up and down. Accordingly, the contacting/distancing link 37 can move up and down. The contacting/distancing lever 25 rides on the contacting/distancing link 37 in a state being biased in the lift-up plate 31 direction by a biassing member (omitted from illustration), and pivots up and down in conjunction with the up and down moment of the contacting/distancing link 37. Also, the feed roller unit 21 is detachably attached to the feeding frame 22, and the feed roller unit 21 rocks in conjunction with operation of the contacting/distancing lever 25.

Figure 5A:
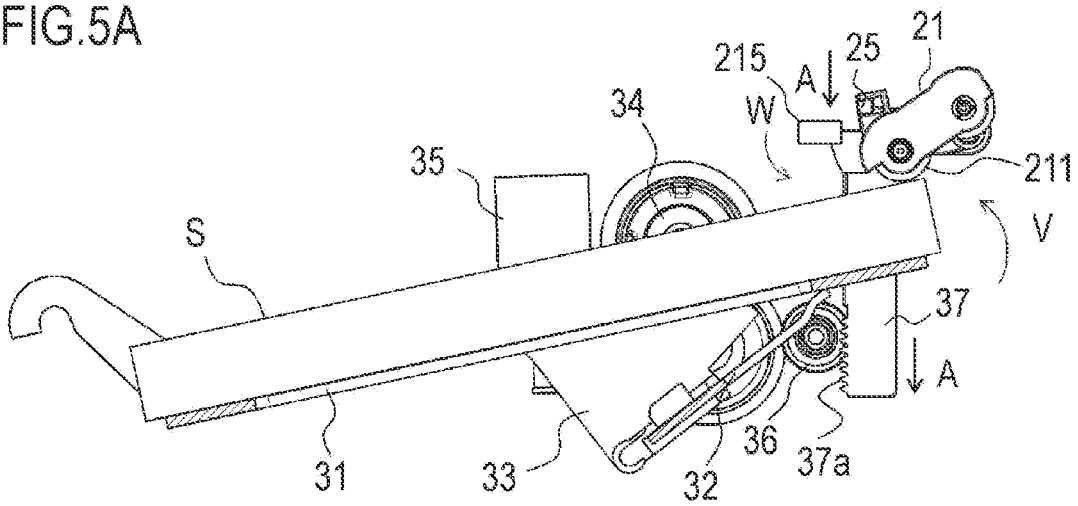
FIGS. 5A and 5B are cross-sectional views illustrating a contact state of a feed roller and a lift-up plate according to the first embodiment.
Figure 5B:
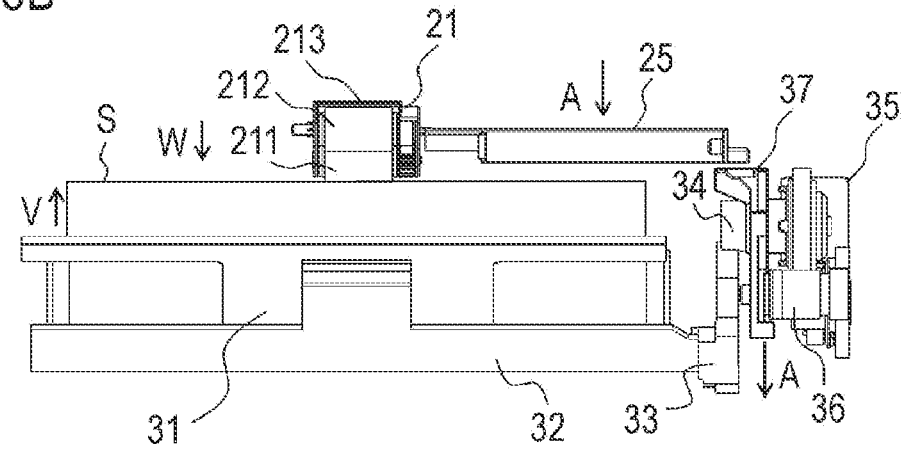
Figure 6A:
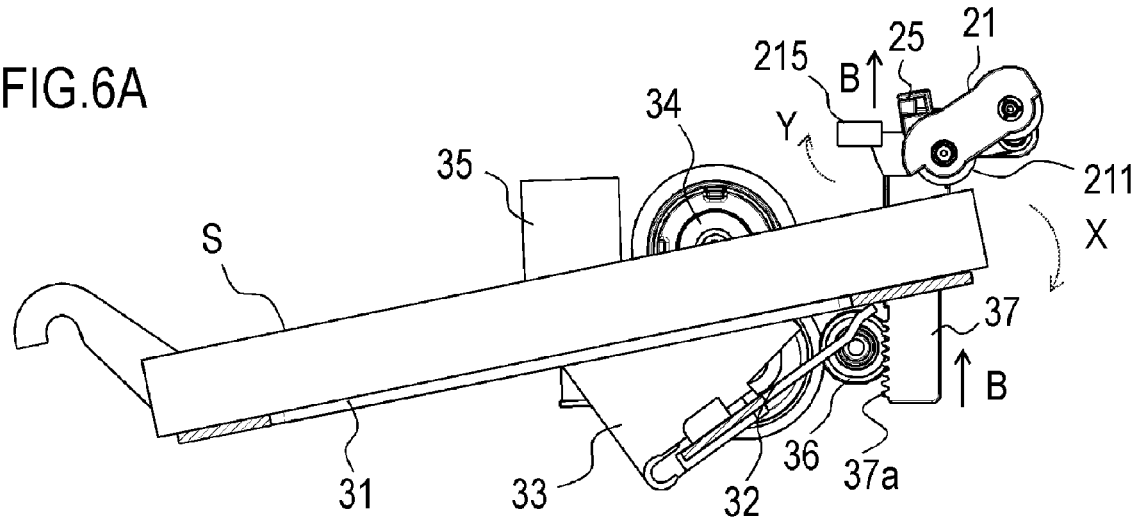
FIGS. 6A and 6B are cross-sectional views illustrating a distanced state of the feed roller and the lift-up plate according to the first embodiment.
Figure 6B:
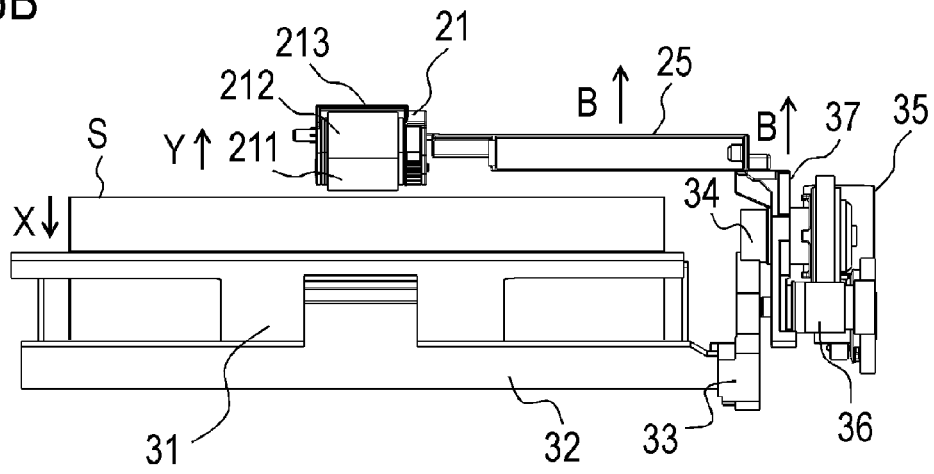

Next, an overview of the contacting/distancing operations of the feed roller 211 and the sheets S in the first embodiment of the present invention will be described with reference to FIGS. 5A and 5B and FIGS. 6A and 6B. FIGS. 5A and 5B illustrate a state in which the feed roller 211 and the sheets S are in contact, and FIGS. 6A and 6B illustrate a state in which the feed roller 211 and the sheets S are distanced. FIGS. 5A and 6A are cross-sectional views illustrating a contact state and a distanced state of the feed roller as viewed from the lateral direction of the conveyance path, and FIGS. 5B and 6B are cross-sectional views illustrating the contact state and the distanced state of the feed roller as viewed from the downstream side in the conveying direction.

The means of bringing sheets S loaded in the cassette unit 3 into contact with the feed roller 211 as illustrated in FIGS. 5A and 5B is as follows. Rotationally driving the lift-up motor 35 in a certain direction causes the contacting/distancing link 37 to descend in the direction of arrow A, and the contacting/distancing lever 25 also descends in the direction of arrow A in conjunction thereof. The feed roller unit 21 pivots in the direction of arrow W in conjunction with the contacting/distancing lever 25.

At this time, as described above regarding the lift-up configuration, the lift-up plate 31 rises in the direction of arrow V to come into contact with the feed roller 211, comes into contact with the feed roller 211, and rises to the feed position of the sheets S. According to the sheet detecting means described above, when the sensor 215 detects the detection portion 213*a* of the roller holder 213, the lift-up motor 35 stops, and thus lift-up and contact of the feed roller 211 are complete. At this time, the lift-up plate 31 and the sheets S are supporting the feed roller unit 21 and the contacting/distancing lever 25.

Next, the means by which the sheets S reach a state of being distanced from the feed roller 211 as in FIGS. 6A and 6B is as follows. Rotationally driving the lift-up motor 35 in an opposite direction causes the rotation of the contacting/distancing gear 36 to be opposite under the rotational driving force in the opposite direction, which causes the contacting/distancing link 37 to rise in the direction of arrow B, and the contacting/distancing lever 25 to be lifted and rise in the direction of arrow B. The feed roller unit 21 pivots in the direction of arrow Y in conjunction with rising of the contacting/distancing lever 25.

At this time, the lift-up drive rotates in the opposite direction from lift-up, and accordingly, the lift-up member 32 pivots downward due to the reverse rotations of the lift-up output gear 33. In conjunction with this, the lift-up plate 31 descends in the direction of arrow X, in the direction of being distanced from the feed roller 211. The feed roller 211 and the lift-up plate 31 each pivot in directions of being distanced from each other, and the feed roller 211 is distanced from the sheets S. At this time, the contacting/distancing link 37 is supporting the feed roller unit 21 and the contacting/distancing lever 25.

Next, details of distancing operations in the first embodiment according to the present invention will be described with reference to FIGS. 7A and 7B through FIGS. 12A and 12B.

FIGS. 7A and 7B through FIGS. 10A and 10B are diagrams illustrating distancing operations of the feed roller 211 and the lift-up plate 31 in a simplified manner. FIGS. 7A, 8A, 9A, and 10A are cross-sectional views illustrating the state of the feed roller and the lift-up plate 31 as viewed from the lateral direction of the conveyance path, and FIGS. 7B, 8B, 9B, and 10B are cross-sectional views illustrating the state of the feed roller and the lift-up plate 31 as viewed from the downstream side in the conveying direction. Here, a dotted line t indicates a sheet S supply position, a dotted line u indicates a sensor detection position, a dotted line f indicates a position of a plane at which the feed roller 211 comes into contact with the sheets, a dotted line g indicates a position of a plane at which the sheets S come into contact with the feed roller 211, a dotted line h indicates a position of a plane at which the contacting/distancing lever 25 comes into contact with the contacting/distancing link 37, and a dotted line i indicates a position of a plane at which the contacting/distancing link 37 comes into contact with the contacting/distancing lever 25.

FIG. 11 is a table showing relations between detection states of the sensor 215 detecting the position of the feed roller 211 at the time of the feed roller 211 and the lift-up plate 31 illustrated in FIGS. 7A and 7B through FIGS. 10A and 10B transitioning from a contact state to a distanced state, and members supporting the feed roller unit 21 and the contacting/distancing lever 25.

Figure 7A:
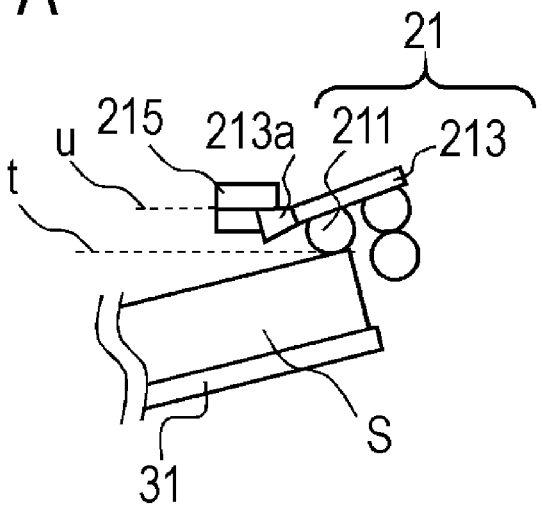
FIGS. 7A and 7B are simplified cross-sectional views illustrating the contact state of the feed roller and the lift-up plate according to the first embodiment.
Figure 7B:
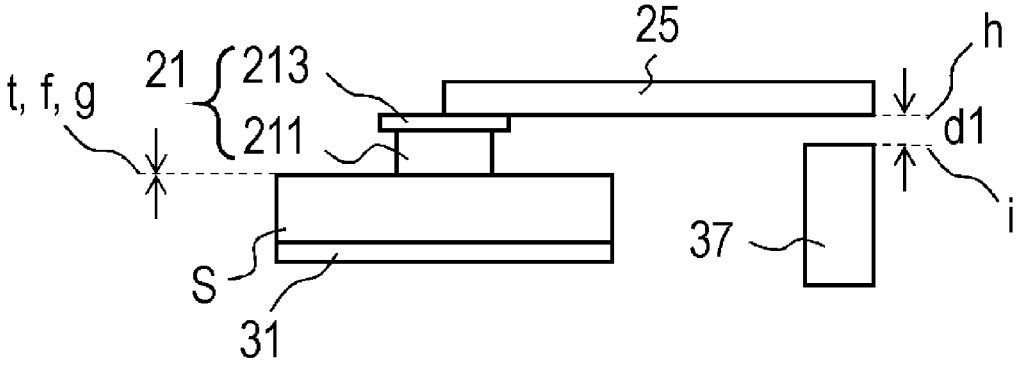

FIGS. 7A and 7B represent a state in which the feed roller 211 and the sheets S are in contact (state in which the feed roller 211 is at a contact position). The sensor 215 at this time is in a light-shielding (on) state (state in which the feed roller 211 is detected at the feed position from which sheets can be fed), and the members supporting the feed roller unit 21 and the contacting/distancing lever 25 are the lift-up plate 31 and the sheets S.

There also is a certain spacing d1 between the contacting/distancing link 37 and the contacting/distancing lever 25 at this time. That is to say, this is a noncoupled state in which the operations of the contacting/distancing link 37 are not transmitted to the contacting/distancing lever 25. The feed roller 211 is biased in the direction of being pressed against the sheets S by a biasing member (omitted from illustration) via the contacting/distancing lever 25 to feed the sheets S, but the force pressing the contacting/distancing lever 25 is not transmitted to the contacting/distancing link 37 due to the spacing d1 between the contacting/distancing link 37 and the contacting/distancing lever 25, and accordingly stable feeding operations can be realized.

Also, the dotted line t (sheet S feed position), the dotted line f (position of plane at which feed roller 211 comes into contact with sheets), and the dotted line g (position of a plane at which sheets S come into contact with feed roller 211) are all at the same position.

Figure 8A:
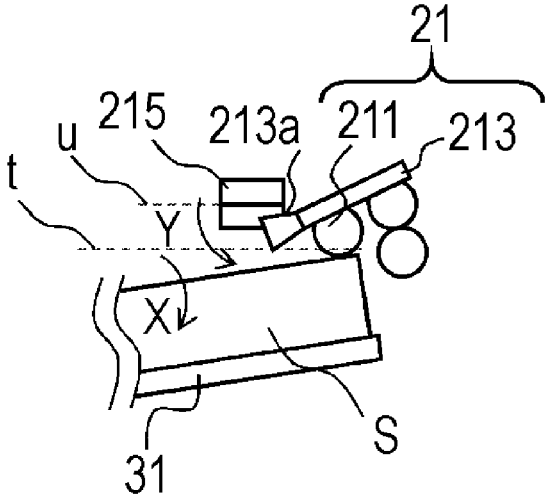
FIGS. 8A and 8B are simplified cross-sectional views illustrating distancing operations of the feed roller and the lift-up plate according to the first embodiment.
Figure 8B:
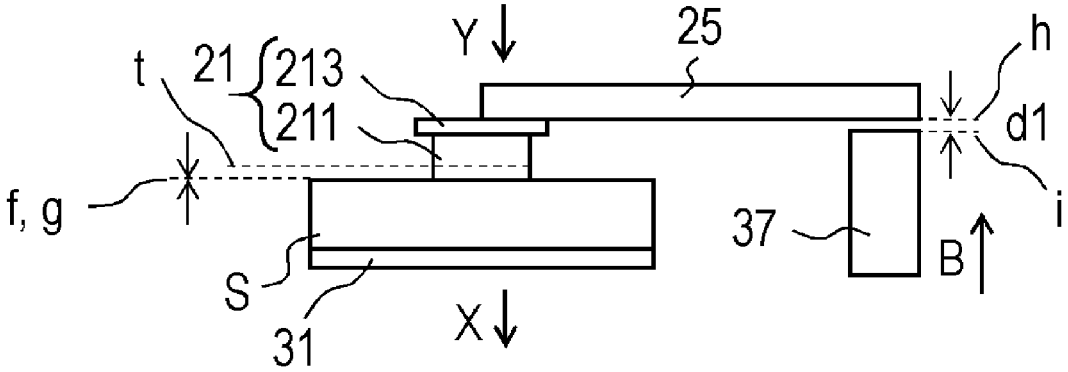

FIGS. 8A and 8B represent a state in which the lift-up plate 31 is in a state of performing distancing operations in a lift-down (descending operation) direction in a state where the feed roller 211 and the sheets S are in contact. The sensor 215 at this time is in a transmitting (off) state (state in which feed roller 211 is detected at a height away from feed position), and the members supporting the feed roller unit 21 and the contacting/distancing lever 25 are the lift-up plate 31 and the sheets S.

In conjunction with the distancing operations, the lift-up plate 31 descends in the direction of arrow X, the feed roller unit 21 and the contacting/distancing lever 25 pivot in the direction of arrow Y, and the contacting/distancing link 37 rises in the direction of arrow B. At this time, the spacing d1 between the contacting/distancing link 37 and the contacting/distancing lever 25 is narrower as compared to the contact state illustrated in FIGS. 7A and 7B. Also, the dotted line f (position of plane at which feed roller 211 comes into contact with sheets S) and the dotted line g (position of plane at which sheets S come into contact with feed roller 211) are situated lower than the dotted line t (sheet S feed position).

Figure 9A:
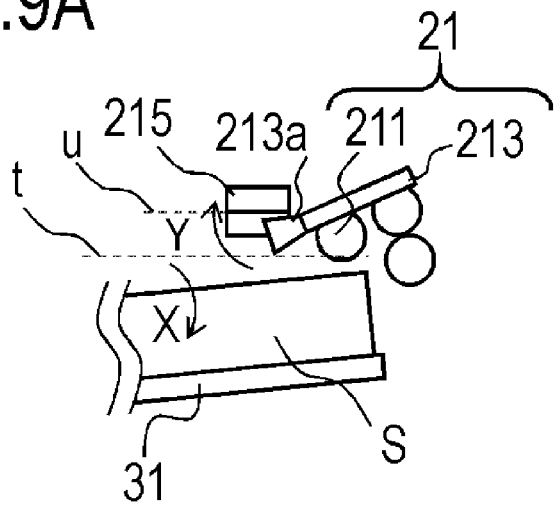
FIGS. 9A and 9B are simplified cross-sectional views illustrating distancing operations of the feed roller and the lift-up plate according to the first embodiment.
Figure 9B:
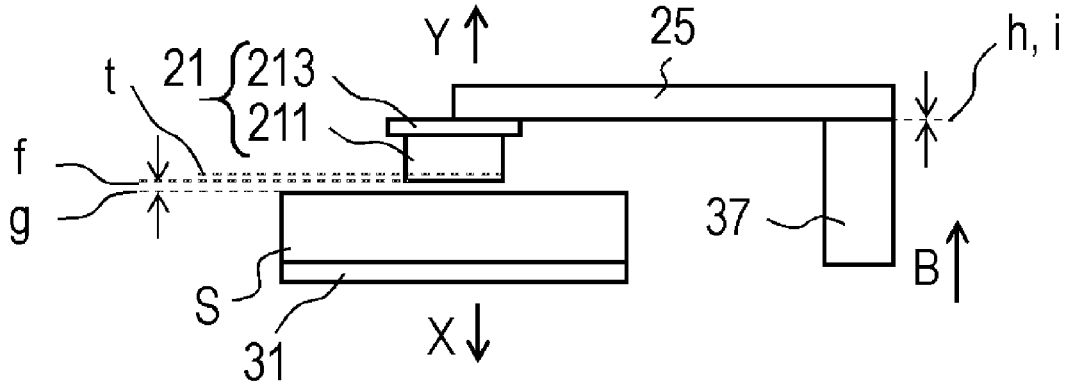

FIGS. 9A and 9B represent a state of operations in which the feed roller 211 and the lift-up plate 31 move in directions of being distanced from each other. Further continuing distancing operations from the state in FIGS. 8A and 8B makes the spacing d1 between the contacting/distancing link 37 and the contacting/distancing lever 25 gradually narrower, and thereafter coming into contact, and thereupon the contact state between the sheets S and the feed roller 211 is disengaged (feed roller 211 rises upward and is distanced from sheets S). That is to say, this is a coupled state in which the operations of the contacting/distancing link 37 are transmitted to the contacting/distancing lever 25, and rising of the contacting/distancing link 37 also raises the contacting/distancing lever 25.

Thereafter, the lift-up plate 31 descends in the direction of arrow X, the feed roller unit 21 and the contacting/distancing lever 25 pivot in the direction of arrow Y, and the contacting/distancing link 37 rises in the direction of arrow B. The sensor 215 is in a transmitting (off) state at this time, and the member supporting the feed roller unit 21 and the contacting/distancing lever 25 is the contacting/distancing link 37. The dotted line f (position of plane at which feed roller 211 comes into contact with sheets) and the sheets S are situated lower than the dotted line t (sheet S feed position), in a state distanced from the dotted line g (position of plane at which sheets S come into contact with feed roller 211).

Figure 10A:
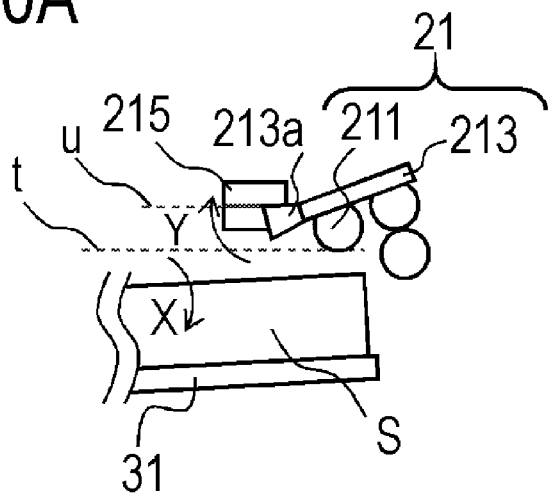
FIGS. 10A and 10B are simplified cross-sectional views illustrating a distancing-completed state of the feed roller and the lift-up plate according to the first embodiment.
Figure 10B:
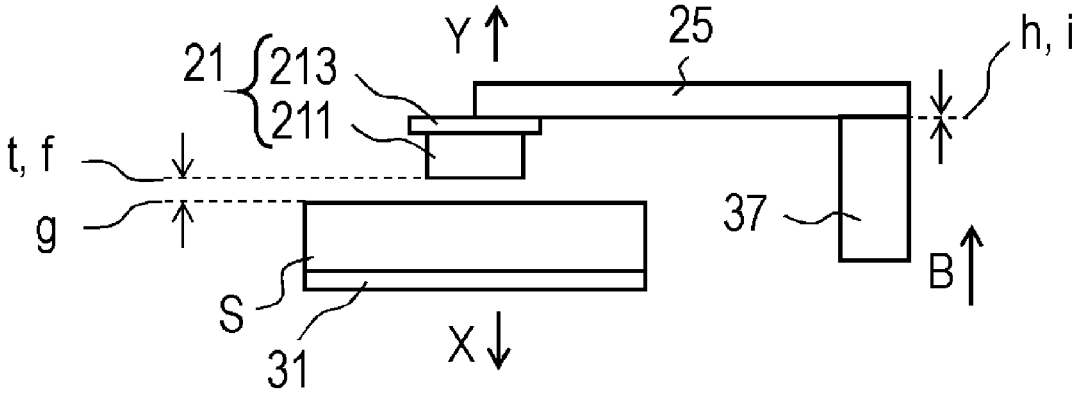

FIGS. 10A and 10B represent a state in which distancing of the feed roller 211 and the sheets S is completed. By further continuing distancing operations from the state in FIGS. 9A and 9B, the lift-up plate 31 descends in the direction of arrow X, the feed roller unit 21 and the contacting/distancing lever 25 pivot in the direction of arrow Y, and the contacting/distancing link 37 rises in the direction of arrow B. At this time, the contacting/distancing link 37 presses the contacting/distancing lever 25 upward against the biasing force acting on the contacting/distancing lever 25, whereby the feed roller 211 and the sheets S are distanced in a sure manner.

Now, stopping the distancing operations the instant that the detecting state of the sensor switches from the transmitting (off) state to the light-shielding state (on) enables the variance in the distancing position between the feed roller 211 and the sheets S to be minimalized, and accordingly, reduction of the size of the apparatus can be realized without the increased costs of adding a new sensor for detecting the distancing positions of the feed roller unit 21 and the lift-up plate 31, or using a drive source capable of rotation guaranteeing control for distancing operations.

At this time, the member supporting the feed roller unit 21 and the contacting/distancing lever 25 is the contacting/distancing link 37. Also, the dotted line t (sheet S feed position) and the dotted line f (position of plane at which feed roller 211 comes into contact with sheets S) are at the same position.

Figure 12A:
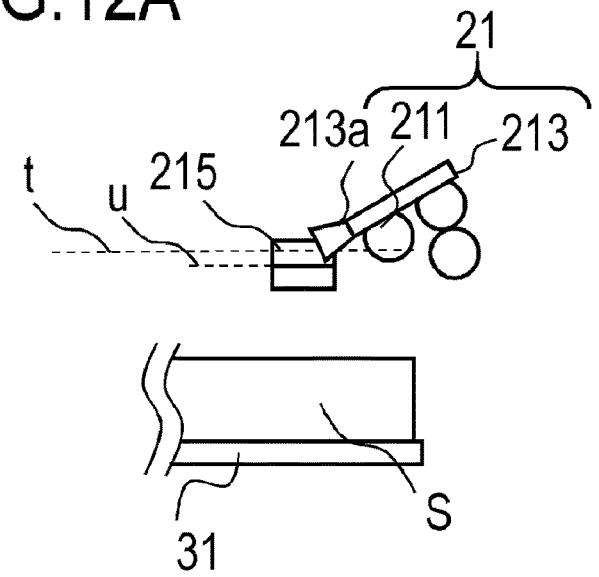
FIGS. 12A and 12B are simplified cross-sectional views illustrating a state before starting lift-up by the feed roller and the lift-up plate according to the first embodiment.
Figure 12B:
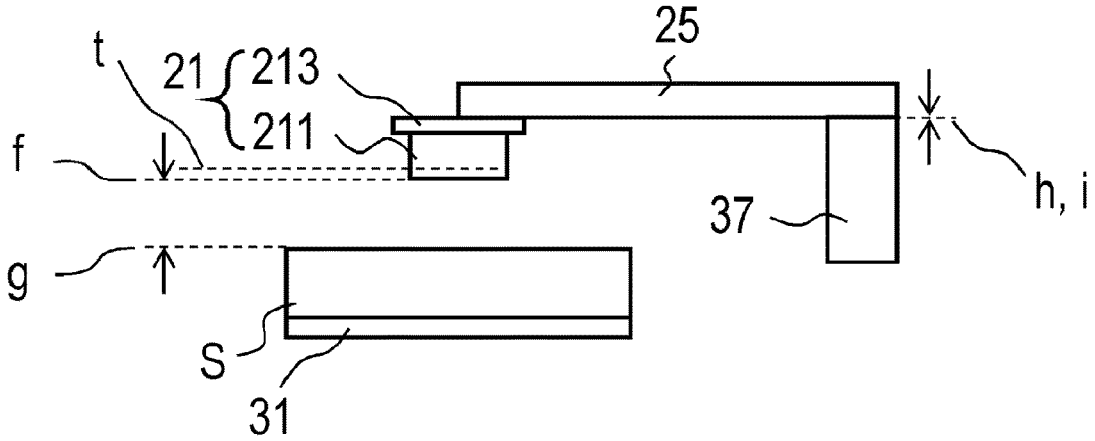

FIGS. 12A and 12B illustrate an initial position before lift-up of the lift-up plate 31, representing that the feed roller 211 is in a descended state. FIG. 12A is a cross-sectional view illustrating the state of the feed roller and the lift-up plate as viewed from the lateral direction of the conveyance path, and FIG. 12B is a cross-sectional view illustrating the state of the feed roller and the lift-up plate as viewed from the downstream side in the conveying direction.

The state in FIGS. 12A and 12B is assumed immediately after the user sets sheets S on the lift-up plate 31 within the cassette unit 3 drawn out of the image forming apparatus and the sheet feed device, and then reinserts the cassette unit 3 into the image forming apparatus and the sheet feed device.

At this time, the sensor is in a transmitting (off) state, and the member supporting the feed roller unit 21 and the contacting/distancing lever 25 is the contacting/distancing link 37. The lift-up plate 31 is lifted up from this state, operations are further continued after the sheets S come into contact with the feed roller 211, and the lift-up is stopped at the timing of the sensor switching to the light-shielding (on) state. Thus, transition to the contact state illustrated in FIGS. 7A and 7B is completed.

By performing detection of the contact state between the feed roller 211 and the sheets S having transitioned to a distanced state by switching of signals of the sensor 215 that detects the position of the topmost face of the sheets S and the position of the feed roller 211, between light-shielding (on), transmitting (off), and light shielding (on), as in the present embodiment, positional variance of members driven at the time of distancing can be minimized without the increased costs of using a drive source capable of rotation guaranteeing control for distancing operations, or adding a sensor that can detect that the feed roller 211 and the lift-up plate 31 have risen to the distanced position.

The switching of signals of the sensor 215 between light-shielding (on), transmitting (off), and light shielding (on), as described above, can be generated by using the lift-up motor 35 to run both of the lift-up plate 31 and the feed roller unit 21. Minimization in variance in distancing position between the lift-up plate 31 and the feed roller unit 21 is realized by performing drive control of distancing operations based on switching of the signals of the sensor 215 (determining completion of distancing operations when signal of sensor 215 switches).

Note that while a configuration is made in the present embodiment in which the feed roller unit 21 is detachably mountable to the feeding frame 22, a configuration may be made where the configuration is not detachable, and the connection between the contacting/distancing lever 25 and the feed roller unit 21 is fixed.

Second Embodiment

Next, a second embodiment of the present invention will be described with reference to FIGS. 13A and 13B through FIGS. 21A and 21B. Note that the present embodiment differs from the first embodiment with regard to the linking configuration of a feed roller contacting/distancing portion. Also, parts in the present embodiment that have the same configuration and function as those in the first embodiment are denoted with the same reference signs as in the first embodiment, and repetitive description will be omitted.

Figure 13A:
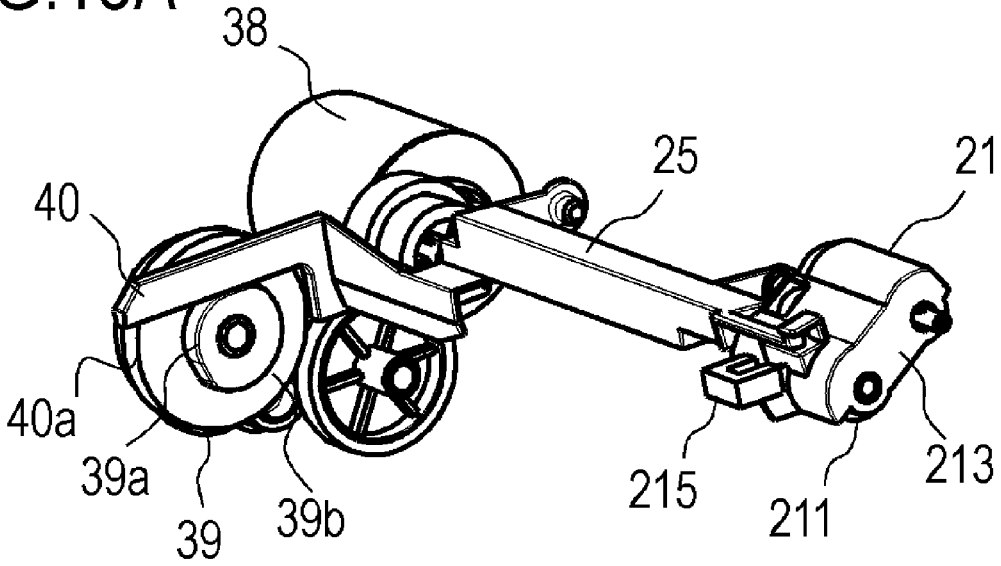
FIGS. 13A and 13B are perspective views illustrating a schematic configuration of a linking configuration that links between the lift-up drive provided to the image forming apparatus and a feed roller contacting/distancing configuration, which is a second embodiment.
Figure 13B:
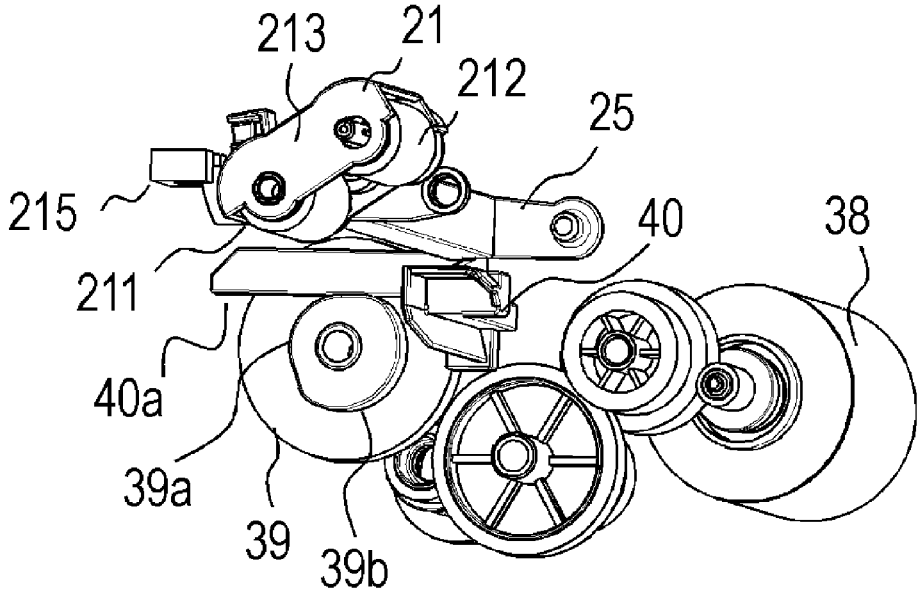

First, the overall configuration will be described with reference to FIGS. 13A and 13B. FIGS. 13A and 13B represent a linking configuration of the feed roller contacting/distancing portion. FIG. 13A is a perspective view of the feed roller contacting/distancing portion from the upstream side in the conveying direction, and FIG. 13B is a perspective view of the feed roller contacting/distancing portion from the downstream side in the conveying direction.

The feed roller contacting/distancing portion is configured of a feed conveying motor 38 that performs driving transmission of the feed roller 211 and the conveying roller 212 in the direction of conveying sheets S at the time of conveying, at the time of forward rotation, a contacting/distancing cam gear 39 that does not transmit forward rotation driving of the feed conveying motor 38 and transmits only reverse rotation driving, a contacting/distancing slider 40 that is connected to the contacting/distancing cam gear 39, and the contacting/distancing lever 25 that is connected to the contacting/distancing slider 40 and the feed roller unit 21, and is able to pivot up and down.

A cam receiving face 40*a* is provided to the contacting/distancing slider 40 serving as a slider member, and converts rotational movement of the contacting/distancing cam gear 39 rotating under reverse rotation driving of the feed conveying motor 38 into up-down moment, as a coupling member. Thus, the contacting/distancing slider 40 is capable of moving up and down.

A contacting cam face 39*a* and a distancing cam face 39*b* are each provided on the contacting/distancing cam gear 39, and when the contacting cam face 39*a* faces the cam receiving face 40*a*, the contacting/distancing slider 40 moves to the contacting position of the feed roller 211, and when the distancing cam face 39*b* faces the cam receiving face 40*a*, the contacting/distancing slider 40 moves to the distancing position of the feed roller 211.

The contacting/distancing lever 25 rides on the contacting/distancing slider 40 in a state of being biased in the direction of the lift-up plate 31 by a biasing member (omitted from illustration), and pivots up and down in conjunction with the up and down movement of the contacting/distancing slider 40. The feed roller unit 21 is detachably attached to the feeding frame 22, and the feed roller unit 21 rocks in conjunction with the operations of the contacting/distancing lever 25.

Figure 14A:
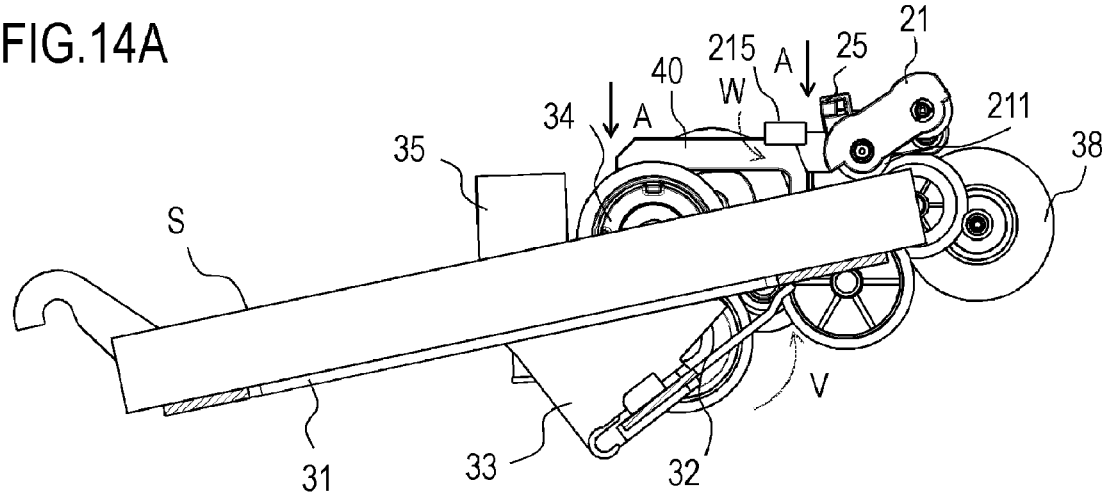
FIGS. 14A and 14B are cross-sectional views illustrating a contact state of a feed roller and a lift-up plate according to the second embodiment.
Figure 14B:
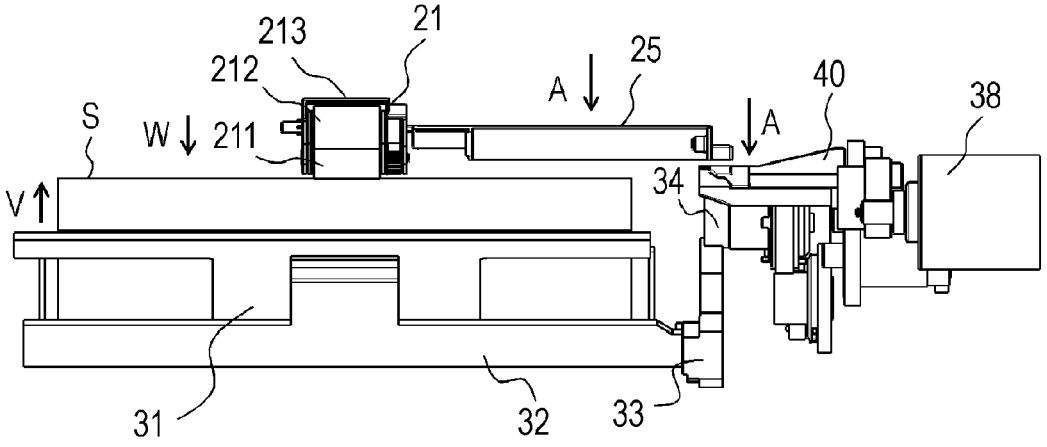
Figure 15A:
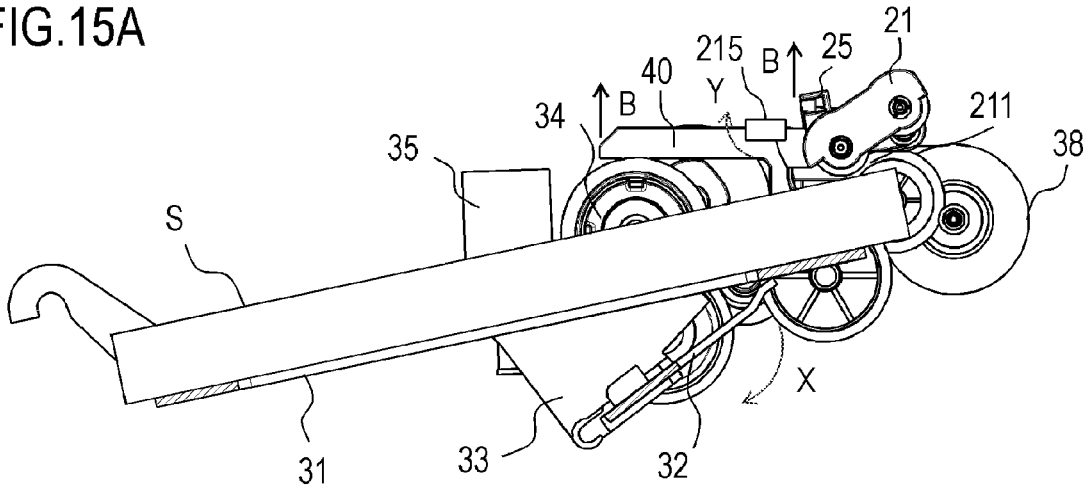
FIGS. 15A and 15B are cross-sectional views illustrating a distanced state of the feed roller and the lift-up plate according to the second embodiment.
Figure 15B:
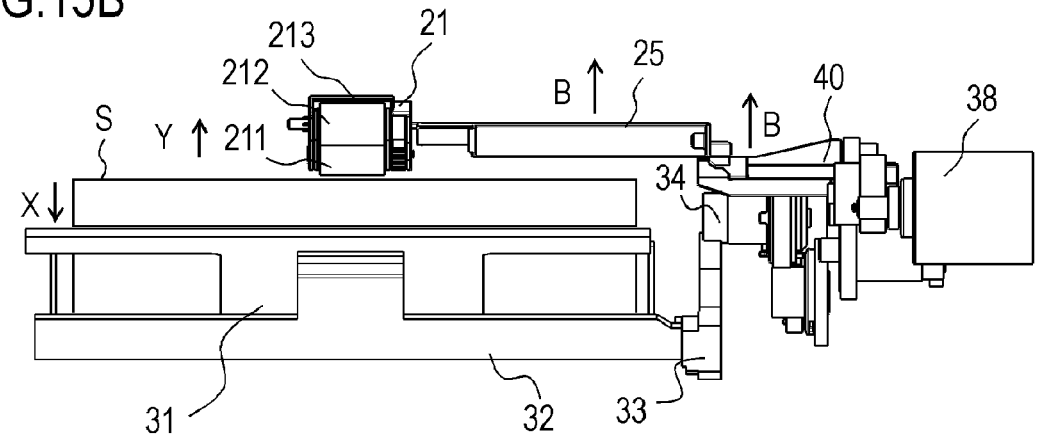

Next, an overview of contacting/distancing operations between the feed roller 211 and the sheets S in the second embodiment of the present invention will be described with reference to FIGS. 14A and 14B and FIGS. 15A and 15B. FIGS. 14A and 14B illustrate a state in which the feed roller 211 and the sheets S are in contact, and FIGS. 15A and 15B illustrate a state in which the feed roller 211 and the sheets S are distanced. FIGS. 14A and 15A are cross-sectional views illustrating a contact state and a distanced state of the feed roller as viewed from the lateral direction of the conveyance path, and FIGS. 14B and 15B are cross-sectional views illustrating the contact state and the distanced state of the feed roller as viewed from the downstream side in the conveying direction.

The means of bringing sheets S loaded in the cassette unit 3 into contact with the feed roller 211 as in FIGS. 14A and 14B is as follows. When the feed conveying motor 38 is driven in reverse rotation, and the contacting cam face 39*a* comes into contact with the cam receiving face 40*a*, the contacting/distancing slider 40 descends in the direction of arrow A, and in conjunction therewith the contacting/distancing lever 25 also descends in the direction of arrow A. The feed roller unit 21 pivots in the direction of arrow W in conjunction with the contacting/distancing lever 25.

At this time, rotational driving of the lift-up motor 35 in a certain direction causes the lift-up plate 31 to rise in the direction of arrow V to come into contact with the feed roller 211, come into contact with the feed roller 211, and rise to the feed position of sheets S, in the same way as in the first embodiment. When the sensor 215 detects the detection portion 213*a* of the roller holder 213 by the above-described sheet detecting means, the lift-up motor 35 stops, and the lift-up and contact of the feed roller 211 is complete. At this time, the feed roller unit 21 and the contacting/distancing lever 25 are supported by the lift-up plate 31 and the sheets S.

Next, the means by which the sheets S reach a state of being distanced from the feed roller 211 as in FIGS. 15A and 15B is as follows. Rotationally driving the lift-up motor 35 in the opposite direction causes the rotations of the lift-up driving to be to the opposite side as to lift-up, which causes the lift-up member 32 to pivot downward due to reverse rotation of the lift-up output gear 33. In conjunction with this, the lift-up plate 31 descends in the direction of arrow X, being distanced from the feed roller 211.

Thereafter, the feed conveying motor 38 is rotationally driven in reverse, and when the distancing cam face 39*b* faces the cam receiving face 40*a*, the contacting/distancing slider 40 rises in the direction of arrow B, and the contacting/distancing lever 25 is lifted to rise in the direction of arrow B. In conjunction with the rising of the contacting/distancing lever 25, the feed roller unit 21 pivots in the direction of arrow Y. Accordingly, the feed roller 211 and the lift-up plate 31 pivot in directions of being distanced from each other, and the feed roller 211 is distanced from the sheets S. At this time, the feed roller unit 21 and the contacting/distancing lever 25 are supported by the contacting/distancing slider 40.

Next, details of the distancing operations in the second embodiment according to the present invention will be described with reference to FIGS. 16A and 16B through FIGS. 21A and 21B.

FIGS. 16A and 16B through FIGS. 19A and 19B are diagrams illustrating distancing operations of the feed roller 211 and the lift-up plate 31 in a simplified manner. FIGS. 16A, 17A, 18A, and 19A are cross-sectional views illustrating the state of the feed roller and the lift-up plate 31 as viewed from the lateral direction of the conveyance path, and FIGS. 16B, 17B, 18B, and 19B are cross-sectional views illustrating the state of the feed roller and the lift-up plate 31 as viewed from the downstream side in the conveying direction. Here, the dotted line t indicates the sheet S supply position, the dotted line u indicates the sensor detection position, the dotted line f indicates the position of the plane at which the feed roller 211 comes into contact with the sheets, the dotted line g indicates the position of the plane at which the sheets S come into contact with the feed roller 211, the dotted line h indicates the position of the plane at which the contacting/distancing lever 25 comes into contact with the contacting/distancing slider 40, and a dotted line j indicates the position of the plane at which the contacting/distancing slider 40 comes into contact with the contacting/distancing lever 25.

FIG. 20 is a table showing relations between detection states of the sensor 215 detecting the position of the feed roller 211 at the time of the feed roller 211 and the lift-up plate 31 transitioning from a contact state to a distanced state illustrated in FIGS. 16A and 16B through FIGS. 19A and 19B, and members supporting the feed roller unit 21 and the contacting/distancing lever 25.

Figure 16A:
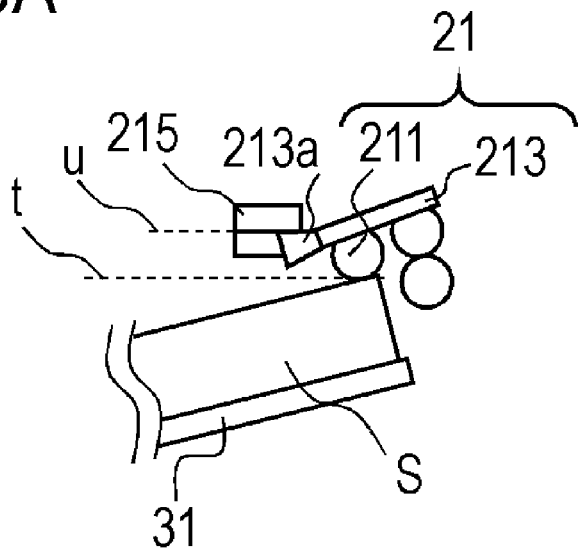
FIGS. 16A and 16B are simplified cross-sectional views illustrating a contact state of the feed roller and the lift-up plate according to the second embodiment.
Figure 16B:
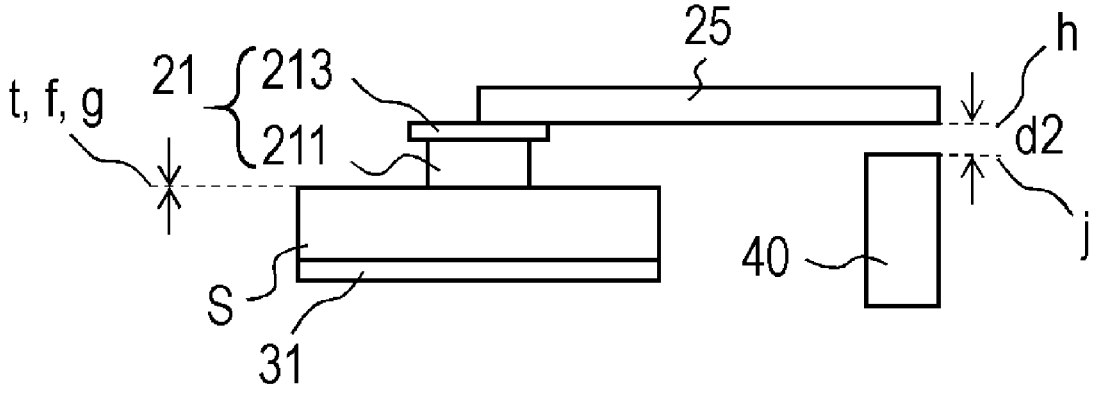

FIGS. 16A and 16B represent a state in which the feed roller 211 and the sheets S are in contact. The sensor 215 at this time is in a light-shielding (on) state, and the members supporting the feed roller unit 21 and the contacting/distancing lever 25 are the lift-up plate 31 and the sheets S.

There is a certain spacing d2 between the contacting/distancing slider 40 and the contacting/distancing lever 25 at this time. The feed roller 211 is biased in the direction toward the sheets S by a biasing member (omitted from illustration) via the contacting/distancing lever 25 to feed the sheets S, but the force pressing the contacting/distancing lever 25 is not transmitted to the contacting/distancing slider 40 due to the spacing d2 between the contacting/distancing slider 40 and the contacting/distancing lever 25, and accordingly stable feeding operations can be realized.

Also, the dotted line t (sheet S feed position), the dotted line f (position of plane at which feed roller 211 comes into contact with sheets), and the dotted line g (position of a plane at which sheets S come into contact with feed roller 211) are all at the same position.

Figure 17A:
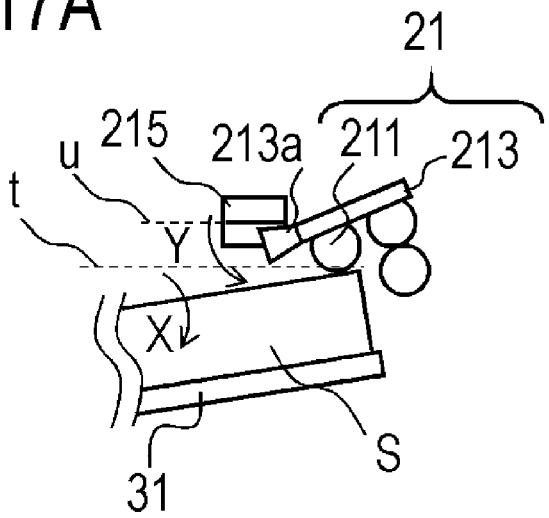
FIGS. 17A and 17B are simplified cross-sectional views illustrating distancing operations of the lift-up plate according to the second embodiment.
Figure 17B:
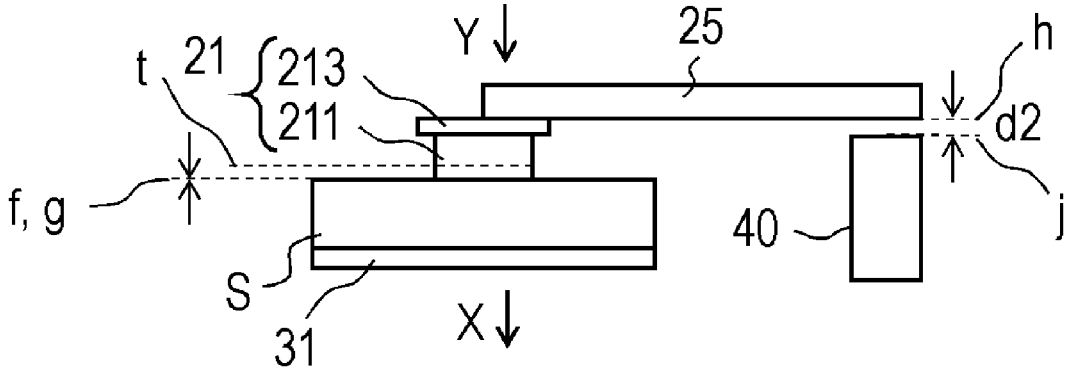

FIGS. 17A and 17B represent a state in which the lift-up plate 31 is performing distancing operations in a lift-down direction in a state where the feed roller 211 and the sheets S are in contact. The sensor 215 at this time is in a transmitting (off) state, and the members supporting the feed roller unit 21 and the contacting/distancing lever 25 are the lift-up plate 31 and the sheets S.

In conjunction with the distancing operations, the lift-up plate 31 descends in the direction of arrow X, and the feed roller unit 21 and the contacting/distancing lever 25 pivot in the direction of arrow Y. At this time, the contacting/distancing slider 40 is not operating, but the spacing d2 between the contacting/distancing slider 40 and the contacting/distancing lever 25 is narrower as compared to the contact state illustrated in FIGS. 16A and 16B.

Also, lift-down operations of the lift-up plate 31 stop at the point in time that the sensor 215 switches to the transmitting (off) state. Now, the dotted line f (position of plane at which feed roller 211 comes into contact with sheets S) and the dotted line g (position of plane at which sheets S come into contact with feed roller 211) are situated lower than the dotted line t (sheet S feed position).

Figure 18A:
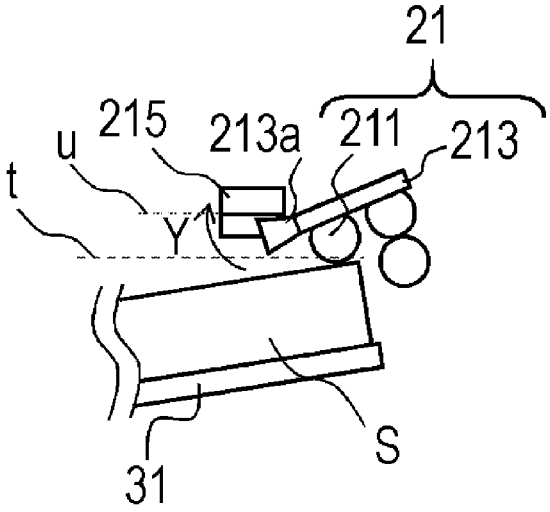
FIGS. 18A and 18B are simplified cross-sectional views illustrating distancing operations of the feed roller according to the second embodiment.
Figure 18B:
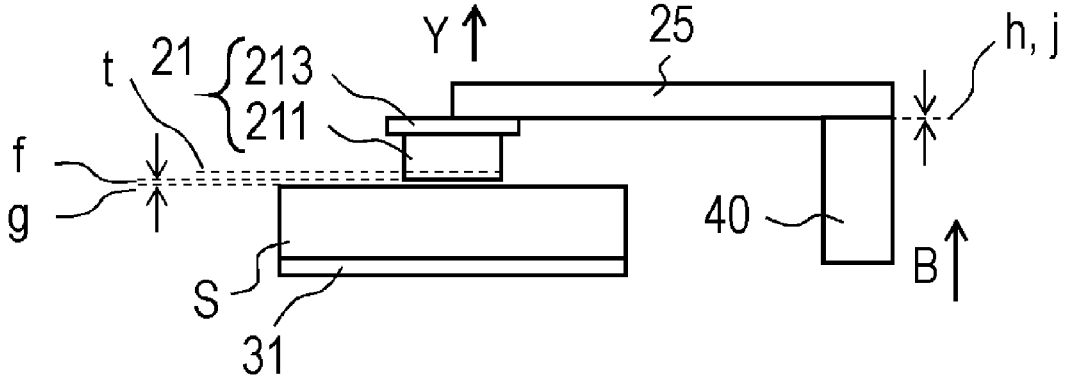

FIGS. 18A and 18B represent a state of the feed roller 211 operating in the direction of distancing from the lift-up plate 31. This operation is caried out after the sensor 215 switches to the transmitting (off) state, and the distancing operations of the lift-up plate 31 stop. Performing distancing operations of the feed roller 211 makes the spacing d2 between the contacting/distancing slider 40 and the contacting/distancing lever 25 gradually narrower, and thereafter coming into contact, and thereupon the contact state between the sheets S and the feed roller 211 is disengaged.

Thereafter, the feed roller unit 21 and the contacting/distancing lever 25 pivot in the direction of arrow Y, and the contacting/distancing slider 40 rises in the direction of arrow B. The sensor 215 is in a transmitting (off) state at this time, and the member supporting the feed roller unit 21 and the contacting/distancing lever 25 is the contacting/distancing slider 40. The dotted line f (position of plane at which feed roller 211 comes into contact with sheets) and the sheets S are situated lower than the dotted line t (sheet S feed position), in a state distanced from the dotted line g (position of plane at which sheets S come into contact with feed roller 211).

Figure 19A:
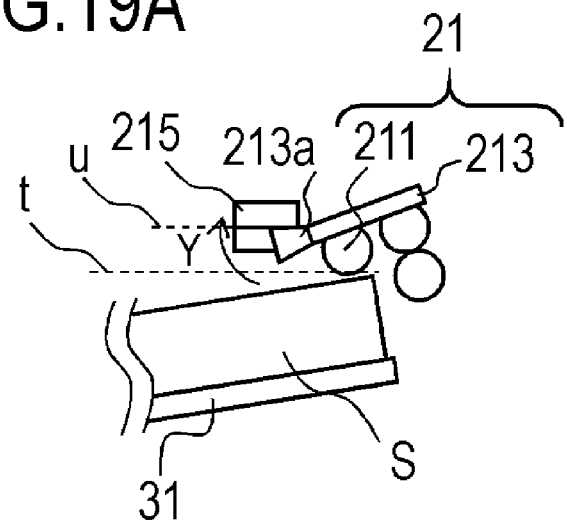
FIGS. 19A and 19B are simplified cross-sectional views illustrating a distancing-completed state of the feed roller and the lift-up plate according to the second embodiment.
Figure 19B:
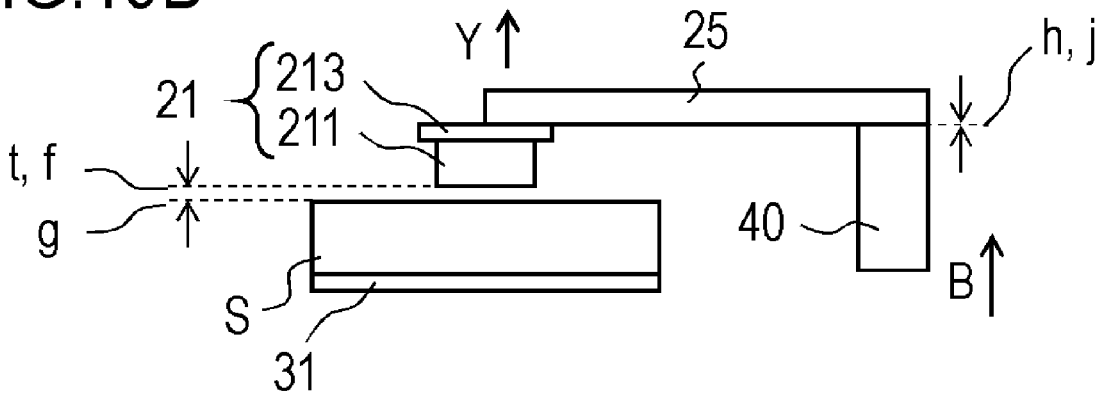

FIGS. 19A and 19B represent a state in which distancing of the feed roller 211 and the sheets S is completed. By further continuing distancing operations of the feed roller 211 from the state in FIGS. 18A and 18B, the feed roller unit 21 and the contacting/distancing lever 25 pivot in the direction of arrow Y, and the contacting/distancing slider 40 rises in the direction of arrow B, and at this time, the feed roller 211 and the sheets S are distanced in a sure manner.

Now, stopping the distancing operations the instant that the detecting state of the sensor switches from the transmitting (off) state to the light-shielding (on) state enables the variance in the distancing position between the feed roller 211 and the sheets S to be minimalized, and accordingly, reduction in the size of the apparatus can be realized without the increased costs of adding a new sensor for detecting the distancing positions of the feed roller unit 21 and the lift-up plate 31, or using a drive source capable of rotation guaranteeing control for distancing operations.

At this time, the member supporting the feed roller unit 21 and the contacting/distancing lever 25 is the contacting/distancing slider 40. Also, the dotted line t (sheet S feed position) and the dotted line f (position of plane at which feed roller 211 comes into contact with sheets) are at the same position.

Figure 21A:
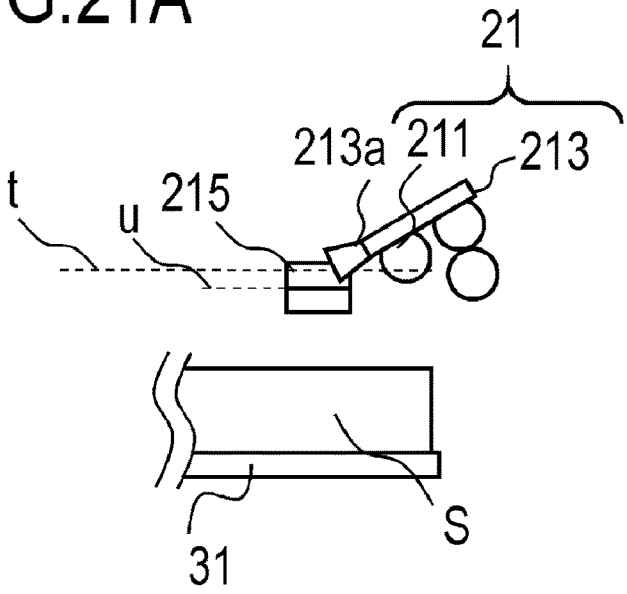
FIGS. 21A and 21B are simplified cross-sectional views illustrating a state before starting lift-up by the feed roller and the lift-up plate according to the second embodiment.
Figure 21B:
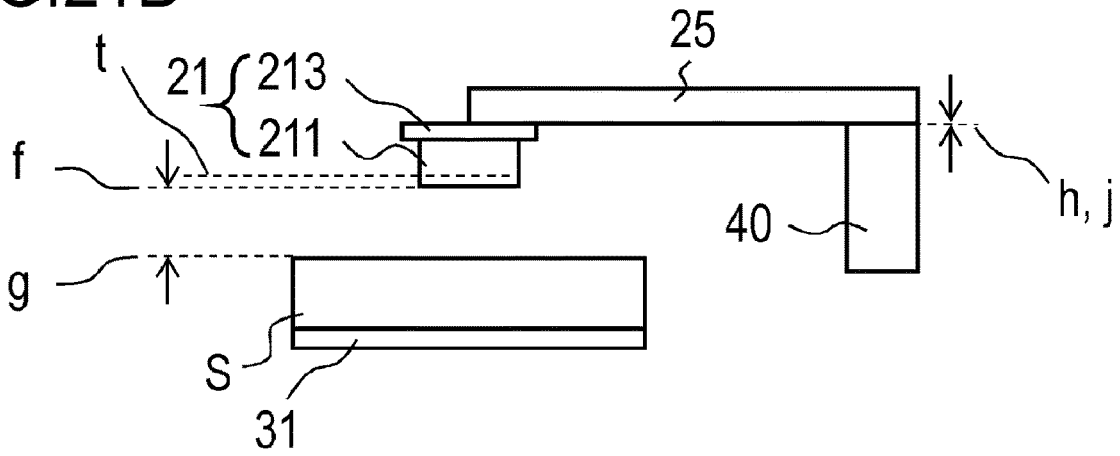

FIGS. 21A and 21B illustrate an initial position before lift-up of the lift-up plate 31, representing that the feed roller 211 is in a descended state. FIG. 21A is a cross-sectional view illustrating the state of the feed roller and the lift-up plate as viewed from the lateral direction of the conveyance path, and FIG. 21B is a cross-sectional view illustrating the state of the feed roller and the lift-up plate as viewed from the downstream side in the conveying direction.

The state in FIGS. 21A and 21B is assumed immediately after the user sets sheets S on the lift-up plate 31 within the cassette unit 3 drawn out of the image forming apparatus and the sheet feed device, and then reinserts the cassette unit 3 into the image forming apparatus and the sheet feed device.

At this time, the sensor is in a transmitting (off) state, and the member supporting the feed roller unit 21 and the contacting/distancing lever 25 is the contacting/distancing slider 40. The lift-up plate 31 is lifted up from this state, operations are further continued after the sheets S come into contact with the feed roller 211, and the lift-up is stopped at the timing of the sensor switching to the light-shielding (on) state. Thus, transition to the contact state illustrated in FIGS. 16A and 16B is completed.

By performing detection of the contact state between the feed roller 211 and the sheets S having transitioned to a distanced state by switching of signals of the sensor 215 that detects the position of the topmost face of the sheets S and the position of the feed roller 211, between light-shielding (on), transmitting (off), and light shielding (on), as in the present embodiment, positional variance of members driven at the time of distancing can be minimized without the increased costs of using a drive source capable of rotation guaranteeing control for distancing operations, or adding a sensor that can detect that the feed roller 211 and the lift-up plate 31 have risen to the distanced position, in the same way as in the first embodiment.

The switching of signals of the sensor 215 between light-shielding (on), transmitting (off), and light shielding (on), as described above, can be generated by using the lift-up motor 35 to run the lift-up plate 31 and using reverse rotation of the feed conveying motor 38 to run the feed roller unit 21. Minimization in variance in distanced position between the lift-up plate 31 and the feed roller unit 21 is realized by performing drive control of distancing operations based on switching of the signals of the sensor 215.

Although a configuration is made in the present embodiment in which the feed roller unit 21 is detachably mountable to the feeding frame 22, in the same way as in the first embodiment, a configuration may be made where the configuration is not detachable, and the connection between the contacting/distancing lever 25 and the feed roller unit 21 is fixed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-068156, filed on Apr. 6, 2020, which is hereby incorporated by reference herein in its entirety.

What is claimed is:

1. A sheet feeding device, comprising:

a sheet loading portion configured to be movable, and on which a sheet is loaded;

a feeding member for feeding the sheet loaded on the sheet loading portion, the feeding member configured to be movable between a contacting state in contact with the sheet, and a distanced state distanced upward from the sheet;

a detecting unit for detecting whether or not the feeding member is at a feeding position where the sheet can be fed; and a control portion that controls a moving operation of the sheet loading portion and a moving operation of the feeding member, wherein, in a case in which the control portion moves the feeding member from the contacting state to the distanced state, the control portion stops a movement of the feeding member at a timing at which the detecting unit detects that the feeding member is at the feeding position after detecting the feeding member is not at the feeding position.

2. The sheet feeding device according to claim 1, wherein, when the feeding member in the contacting state moves to the distanced state, the feeding member descends from a height of the feeding position in conjunction with a descending operation of the sheet loading portion while remaining in contact with the sheet loaded on the sheet loading portion, to reach a height away from the feeding position, and thereafter rises upward to be distanced from the sheet loaded on the sheet loading portion, and returns to the height of the feeding position.

3. The sheet feeding device according to claim 1, further comprising a singular drive source;

a lift-up member for lifting the sheet loading portion, the lift-up member configured to be movable under a driving force supplied from the singular drive source so as to move the sheet loading portion;

a gear that transmits the driving force from the singular drive source to the lift-up member;

a force transmitted member configured to be movable integrally with the feeding member; and a transmitting member for transmitting the driving force to the force transmitted member so as to move the feeding portion, the transmitting member configured to be in a transmitting state in which the driving force is transmitted from the transmitting member to the force transmitted member and in a non-transmitting state in which the driving force is not transmitted from the transmitting member to the force transmitted member, wherein the transmitting member is in the transmitting state after the lift-up member starts descending of the sheet loading portion under the driving force.

4. The sheet feeding device according to claim 3, wherein the gear is configured to rotate under the driving force transmitted from the singular drive source so as to transmit the driving force to the transmitting member in addition to the lift-up member, wherein the transmitting member is configured to be in a first state in which the force transmitted member rides on the transmitting member and in a second state in which the force transmitted member does not ride on the transmitting member, wherein the transmitting member is in the second state at a point of time at which the lift-up member starts descent of the sheet loading portion under the driving force, and thereafter the state of the transmitting member is changed to the first state from the second state.

5. The sheet feeding device according to claim 4, wherein the force transmitted member is biased such that the feeding member is pressed against the sheet loaded on the sheet loading portion, and wherein, when the feeding member is at the feeding position where the sheet can be fed onto a sheet conveyance path, the transmitting member is distanced from the force transmitted member, and when the sheet loading portion starts the descending operation, the transmitting member moves toward the force transmitted member then the state of the transmitting member is changed into the first state from the second state, and presses the force transmitted member upward against a biasing force acting on the force transmitted member, thereby distancing the feeding member from the sheet.

6. The sheet feeding device according to claim 1, further comprising:

a feed roller serving as the feeding member;

a motor for driving the feed roller;

a lever member configured to be movable integrally with the feed roller;

a slider member configured to be advanceable/retractable relative to the lever member; and a coupling member that causes the slider member to advance/retreat relative to the lever member, by being supplied by the motor with a rotational driving force of an opposite direction to a rotational driving force that the motor supplies to the feed roller at a time of feeding the sheet onto a sheet conveyance path, wherein, when the feeding member is at the feeding position where the sheet can be fed onto the sheet conveyance path, the slider member is distanced from the lever member, and when the sheet loading portion starts a descending operation, the slider member moves toward the lever member and comes into contact therewith, and presses the level member upward against a biasing force acting on the lever member, thereby distancing the feeding member from the sheet.

7. The sheet feeding device according to claim 6, further comprising:

a drive source, which is different from the motor;

a lift-up member for lifting the sheet loading portion, the lift-up member configured to be movable under a driving force being supplied from the drive source so as to move the sheet loading portion; and a gear that transmits the driving force from the drive source to the lift-up member.

8. The sheet feeding device according to claim 1, wherein the feeding member is detachably mounted to the sheet feeding device.

9. An image forming apparatus, comprising:

an image forming portion that forms an image on a sheet; and the sheet feeding device according to claim 1 that feeds a sheet to the image forming portion.

* * * * *